US008760291B1

(12) United States Patent
Mullins et al.

(10) Patent No.: US 8,760,291 B1
(45) Date of Patent: Jun. 24, 2014

(54) NOTIFICATION APPARATUS, SYSTEM, AND METHOD

(76) Inventors: Kevin W. Mullins, Wise, VA (US); Gary McConnell, Kingsport, TN (US)

( * ) Notice: Subject to any disclaimer, the term of this patent is extended or adjusted under 35 U.S.C. 154(b) by 319 days.

(21) Appl. No.: 13/220,385

(22) Filed: Aug. 29, 2011

Related U.S. Application Data

(60) Provisional application No. 61/486,907, filed on May 17, 2011, provisional application No. 61/525,552, filed on Aug. 19, 2011.

(51) Int. Cl.
*G08B 13/00* (2006.01)

(52) U.S. Cl.
USPC .. 340/541; 340/5.6; 340/539.13; 340/539.16; 340/539.17

(58) Field of Classification Search
USPC ..... 340/539.1, 539.11, 539.13, 539.16, 340/539.17, 573.1, 573.4, 5.3, 5.6, 5.61, 340/5.64, 5.7, 541
See application file for complete search history.

(56) References Cited

U.S. PATENT DOCUMENTS

| | | | | |
|---|---|---|---|---|
| 5,731,575 | A | 3/1998 | Zingher et al. | |
| 6,965,294 | B1 | 11/2005 | Elliott et al. | |
| 7,287,009 | B1 | 10/2007 | Liebermann | |
| 7,616,942 | B2 | 11/2009 | Karl et al. | |
| 7,825,796 | B1 * | 11/2010 | Simon | 340/539.17 |
| 7,847,675 | B1 | 12/2010 | Thyen et al. | |
| 2003/0034877 | A1 | 2/2003 | Miller et al. | |
| 2006/0017570 | A1 | 1/2006 | Moskowitz et al. | |
| 2006/0022794 | A1 | 2/2006 | Determan et al. | |
| 2006/0279422 | A1 * | 12/2006 | Sweatte | 340/539.13 |
| 2008/0068183 | A1 | 3/2008 | Diamant | |
| 2008/0218373 | A1 | 9/2008 | Lanigan et al. | |
| 2009/0021370 | A1 | 1/2009 | Fish et al. | |
| 2009/0295571 | A1 * | 12/2009 | Hosey | 340/540 |
| 2010/0164683 | A1 * | 7/2010 | Sharma et al. | 340/5.63 |
| 2010/0182123 | A1 * | 7/2010 | Press | 340/5.28 |
| 2010/0194571 | A1 | 8/2010 | Ortiz et al. | |
| 2010/0265034 | A1 | 10/2010 | Cap et al. | |
| 2011/0025459 | A1 | 2/2011 | Denison et al. | |
| 2011/0063076 | A1 | 3/2011 | Kurtz et al. | |
| 2011/0102138 | A1 | 5/2011 | Girard, III et al. | |
| 2011/0103302 | A1 * | 5/2011 | Hall | 370/328 |

* cited by examiner

*Primary Examiner* — Brian Zimmerman
*Assistant Examiner* — Laura Nguyen
(74) *Attorney, Agent, or Firm* — Robinson IP Law, PLLC

(57) ABSTRACT

A notification apparatus, system, and method that provides up-to-the-minute status information for a facility or a group of facilities to an administrator and to persons who work at or otherwise frequent such facility or group of facilities.

18 Claims, 6 Drawing Sheets

NOTIFICATION APPARATUS, SYSTEM, AND METHOD

CROSS-REFERENCE(S) TO RELATED APPLICATION(S)

This application claims priority to U.S. Provisional Patent Application Ser. No. 61/486,907 entitled "The 'All-Clear System' to Notify Financial Services Employees the Status to Enter a Facility" to Kevin W. Mullins which was filed on May 17, 2011, and U.S. Provisional Patent Application Ser. No. 61/525,552 entitled "NOTIFICATION APPARATUS, SYSTEM, AND METHOD" to Kevin W. Mullins and Gary McConnell which was filed on Aug. 19, 2011, the contents of which are incorporated herein by reference in their respective entireties.

FIELD

This disclosure relates to the field of notification systems and devices. More particularly, this disclosure relates to a notification system and apparatus for one or more facilities.

BACKGROUND

Many different companies and government groups have a vested interest in knowing the status of each facility such company or group are responsible for. Some industries are even required to have status identification procedures in place. For example, the Bank Protection Act of 1968 requires banking institutions to establish procedures for opening and closing a facility which provide, for example, some facility status information to persons who have not entered a building. The methodologies used to date for these and related procedures are outdated and well-known and the effectiveness of such methodologies has, according to some, waned over years of use.

What is needed, therefore, is an apparatus, system, and method to almost instantaneously provide status information of a facility to employee personnel and one or more administrators of such facility or facilities.

SUMMARY

The above and other needs are met by an apparatus for notifying personnel associated with a facility of the status of such facility including whether a notice condition presently exists at such facility, the apparatus comprising a primary power source, a user interface located in or adjacent a facility, the user interface including a microprocessor, a user input device in communication with the microprocessor, and a first transceiver in communication with the microprocessor; and a plurality of remote communication tokens, each token including a remote power source, an actuator, a microcontroller in communication with the actuator, a second transceiver in communication with the microcontroller wherein each of the second transceivers are configured for sending signals to and receiving signals from the first transceiver, and a display in each of the remote communications tokens for displaying information based on signals received from the first transceiver, wherein human interaction is required from a first erson to input a confirmation code to the user interface indicating whether the facility is safe to enter for subsequent arriving persons or whether a notice condition exists at such facility, wherein, if a notice condition exists and a confirmation code has been entered indicating such notice condition, a subsequently arriving person using a particular communication token, upon properly engaging the actuator of such particular communication token, will receive a warning message on the subsequently arriving person's particular communication token display while the subsequently arriving person is still safely outside the facility, such warning message indicating the subsequently arriving person should remain outside of the facility. In one example, the apparatus further comprises a timer in communication with the microprocessor, the timer configured to keep track of one or more time periods after a signal is received by the first transceiver from the second transceiver, wherein such signal was initiated by a first person to arrive at the facility on a particular day. In a different example, the apparatus further comprises a controller configured to directly communicate with the user interface and update information stored in the user interface. In yet another example, the apparatus further comprises a first transcoder in communication with the first transceiver and the microprocessor; and a second transcoder in communication with the second transceiver and the microcontroller.

In another aspect, embodiments of the disclosure provide a method of confirming the status of a facility including whether a notice condition presently exists at such facility, the method comprising the steps of (a)(1) conducting a manual security sweep of a facility; (a)(2) inputting a first confirmation code manually at a user interface based on a result of the manual security sweep; (a)(3) updating a present status condition of the facility automatically using the user interface in response to the manually input first confirmation code; (b) transmitting a first request signal from a remote communication token within a minimum range of a user interface located in or proximate a facility; (c) receiving the first request signal at the user interface; (d) transmitting a first reply signal from the user interface in response to the first request signal, wherein the transmitted first reply signal is based on the present status condition of the facility; (e) receiving the first reply signal at the remote communication token; and (f) displaying a message on the remote communication token indicating the present status condition of the facility. In one example, the displayed message of step (f) further comprises the substep of notifying a user that the user is the first person to approach the facility during a first time period. In another related example, step (c) further comprises the substep of verifying an identity of the remote communication token that transmitted the first request signal to determine whether the first request signal originated from an authorized remote communication token. In another related example, step (g) includes entering an access code into a user input device at the user interface. In yet another related example, the method further comprises (g) initiating a timer to keep track of the time between when the first reply signal was sent and when a confirmation code, if any, is later entered by a user at the user interface and (h) transmitting a notice message from the user interface to an administrator if the user does not enter a confirmation code at the user interface within a pre-set time limit after the first reply signal was sent. In an alternate example, the method comprises the step of (g)' inputting a confirmation code at the user interface within a pre-set time limit after the first reply signal was sent. In one example, the method further comprises the step of (h)' updating a present status condition of the facility. In a related example, step (h)' further comprises the substep of authenticating the confirmation code entered at the user interface prior to updating the present status condition of the facility. In yet another related example, the confirmation code entered at the user interface is associated with a notice condition, the method further comprises the steps of (h)" sending a notice message to an administrator based on the type of notice condition indicated by the confirmation code entered at the user interface; and (j) updating the present status condition of the facility. In an alternative example, the method further comprises the step of (g)" saving identification information associated with the remote communication token and (h)'" saving the time at which the remote communication token transmitted the first request signal. In a related example, the method further comprises the steps of (i)' initiating a timer to count down the time between the saved time at which the remote communication token transmitted the first request signal and a future time window during which a subsequent request signal is expected to be transmitted from the remote communication token and received at a second user interface located at a facility remote from the facility at which the first user interface is located; and, in the event a signal is not received at the second user interface from the remote communication token within the future time window, (j) sending a notice message to an administrator. The notice message can be sent, for example, from a user interface and/or an administration control apparatus.

In another aspect, embodiments of the disclosure provide a notification system for notifying personnel associated with one or more facilities of the status of at least one of the one or more facilities including whether a notice condition presently exists at one or more of the facilities, the notification system comprising a user interface located in or adjacent each facility, each user interface including a microprocessor, a user input device in communication with the microprocessor, and a primary transceiver in communication with the microprocessor; and a plurality of remote communication tokens, each remote communication token including an actuator, a microcontroller in communication with the actuator, a secondary transceiver in communication with the microcontroller wherein each of the secondary transceivers are configured for sending signals to and receiving signals from a primary transceiver of the one or more user interfaces, and a display in each of the remote communications tokens for displaying information based on signals received from a primary transceiver of one or more user interfaces, wherein human interaction is required from a first person to input a confirmation code to at least one of the user interfaces indicating whether the facility associated with the at least one of the user interfaces is safe to enter for subsequent arriving persons or whether a notice condition exists at the facility associated with the at least one of the user interfaces, wherein, if a notice condition exists and a confirmation code has been entered indicating such notice condition at the facility associated with the at least one of the user interfaces, a subsequently arriving person using a particular communication token, upon properly engaging the actuator associated with the particular communication token, will receive a warning message on the subsequently arriving person's particular communication token display while the subsequently arriving person is still safely outside the facility associated with the at least one of the user interfaces, such warning message indicating the subsequently arriving person should remain outside of the facility associated with the at least one of the user interfaces. In a related example, the notification system further comprises an administration control apparatus remotely located relative to the one or more facilities wherein the administration control apparatus is in communication with the respective user interfaces at each of the one or more facilities via a local network, the Internet, or a combination thereof, and wherein the administration control apparatus is configured to receive notice messages from the user interface at each of the one or more facilities, and assign present status conditions for the one or more facilities based at least in part on the receipt of a notice message. In a further related example, the notification system comprises the administration control apparatus wherein the administration control apparatus is configured to receive audit information from each user interface on a time basis of at least less than every twenty-four hour interval. In a further related example, the notification system comprises the administration control apparatus wherein the administration control apparatus is further configured to store information including audit information. In another example, the notification system further comprises a master configuration apparatus remotely located relative to the one or more facilities wherein the master configuration apparatus is in communication with the user interfaces via a local network, the Internet, or a combination thereof, and wherein the master configuration apparatus is configured to manage the initial configuration and setup of a user interface at the one or more facilities. In a further related example, the notification system further comprises the master configuration apparatus wherein the user interfaces are identifiable based on unique Media Access Control addresses associated with respective user interfaces, such Media Access Control addresses being stored in the master configuration apparatus; and wherein the master configuration apparatus is configured for at least storing valid Internet Protocol address information of Internet Protocol addresses directly associated with new hardware that forms at least part of each respective user interface, such storage of valid Internet Protocol address information providing cross-referencing capability for the master configuration apparatus to identify specific customer identities based on the Internet Protocol addresses and Media Access Control addresses from which each customer's new hardware sends out an initial signal to the master configuration apparatus. In a related embodiment, the method further comprises the steps of initiating a timer to count down the time between the saved time at which the remote communication token transmitted the first request signal and a future time window during which a subsequent request signal is expected to be transmitted from the remote communication token and received at a second user interface located at a facility remote from the facility at which the first user interface is located; and, in the event a subsequent request signal is not received at the second user interface from the remote communication token within the future time window, sending a notice message from the second user interface to an administrator.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Administrator: a person or processing apparatus remote from a facility of interest, wherein the administrator takes one or more actions based on the receipt of a notice message and the content of such notice message, such action or inaction being taken based on a response protocol (for a person acting as an administrator) and/or a control logic scheme (for a processing apparatus operating as an administrator). The administrator preferably includes an administration control apparatus as described in more detail herein.

Notice condition: a term identifying a particular status of a facility in which an abnormal and/or undesirable event has occurred or is occurring which requires special precautions, actions, and/or inactions be taken by persons outside the facility.

Notice message: a message sent to an administrator in the event a notice condition or other non-nominal condition is assigned to a facility based on, for example, the entry of a particular code indicating any non-nominal condition, the failure of a person to enter a particular code and/or actuate a remote communication token, or the failure of a person to enter any code and/or actuate a remote communication token within a pre-defined time limit.

Nominal condition: a term identifying a particular status of a facility in which all things are operating normally and no known notice condition exists.

User input device: an apparatus configured so that a user can enter information to a third device that is in (or will be in) communication with the user input device. Examples include a keypad, a touchpad, a touchscreen, a keyboard, a mouse, and a microphone.

Figure 1:
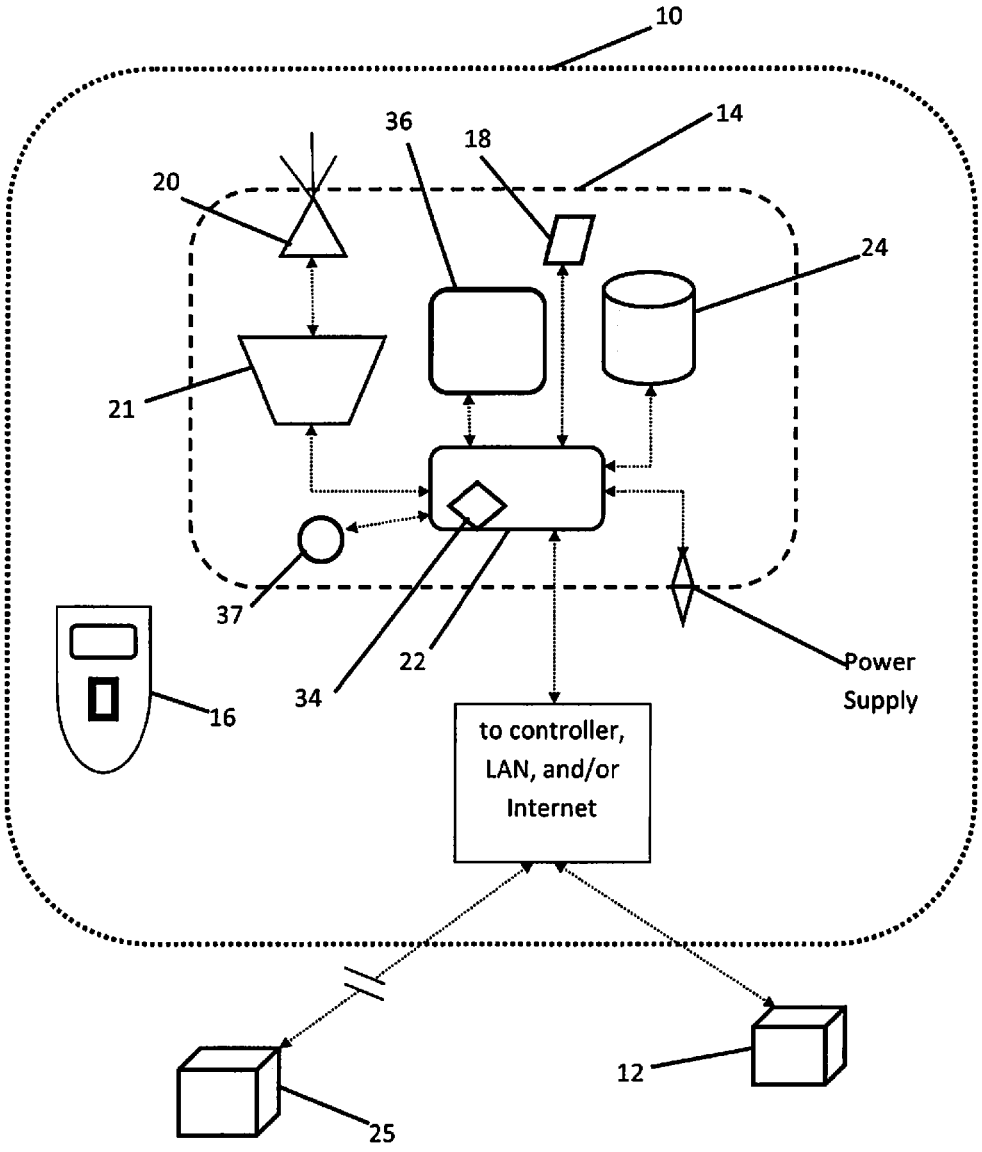
FIG. 1 shows a schematic view of an example of a status notification apparatus.
Figure 2:
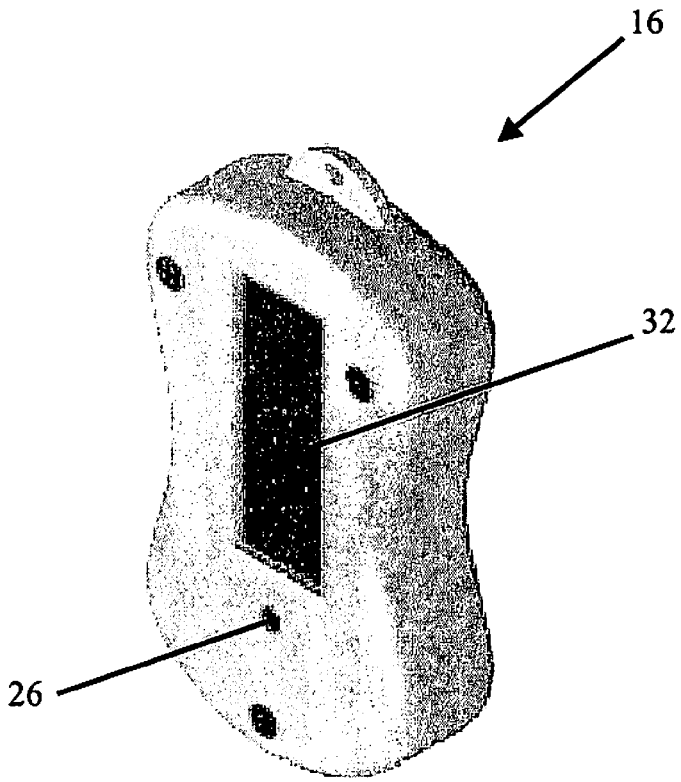
FIG. 2 shows an illustration of an example of a remote communication token forming part of a status notification apparatus.

FIG. 1 shows a simple schematic diagram of a facility status communications apparatus 10 including a controller 12, a user interface 14, and a remote communication token 16 (e.g., a "key fob"). Each employee or other regularly visiting personnel preferably are provided an embodiment of the remote communication token 16 wherein each token is uniquely identifiable. The remote communication token 16 is configured for wireless communication with the user interface 14 wherein a user can engage the remote communication token 16 which causes a wireless signal to be transmitted to the user interface 14. An example of a form of the remote communication token 16 is shown in FIG. 2, showing a key fob. Upon receiving the wireless signal from the remote communication token 16, the user interface transmits a response signal with specific information regarding the status of a facility to which the facility status communications apparatus 10 is assigned. Such information from the response signal informs the user as to what steps, if any, he or she should take next (e.g., whether to enter the facility).

With reference again to FIG. 1, the user interface 14 includes a user input device 18 for a user to directly interface with the user interface 14 and a radio transceiver 20 for communication with the remote communication token 16, wherein the radio transceiver 20 is preferably in communication with a transcoder 21 for encrypting and/or decrypting communication signals from and/or to the radio transceiver 20. The user interface 14 is also configured to interface with the controller 12 via wire (e.g., IEEE 802 wire such as a CATS cable, IEEE 1394 wire, Universal Serial Bus wire) or wirelessly (e.g., via Wifi™, Bluetooth™) wherein the controller 12 can be used, for example, to program the user interface 14. The user interface 14 also includes a microprocessor 22 for processing the information received and sent to the user interface 14. Preferably, the user interface includes a memory module 24 for storing information regarding communication events including, for example, the identities of the remote communication tokens that send requests for information to the user interface, the information sent in reply to such requests, the times such requests were received, and the times such responses were transmitted, all of which are defined herein as "audit records" or "audit information". In one embodiment, a user at the user interface 14 can input a unique code at the user input device 18 causing the software being run on the user interface to allow control of the user interface 14 to be switched to a remote computer 25 for special configuration, reprogramming, updating or other reasons.

Figure 3:
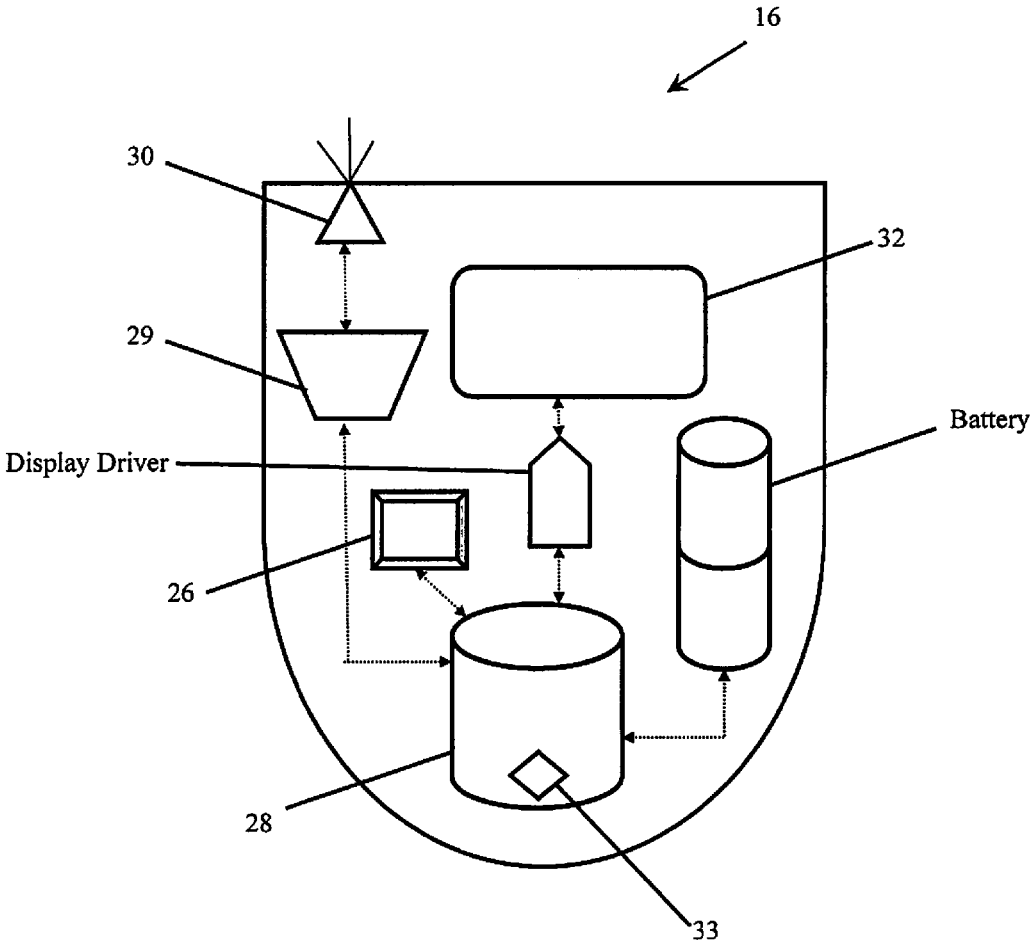
FIG. 3 shows a schematic view of a remote communication token.

FIG. 3 shows a more detailed schematic view of an example of the remote communication token 16 wherein the remote communication token 16 includes an actuator 26 (e.g., engagable switch; piezoelectric actuation device) in communication with a microcontroller 28 which, in turn, is in communication with a radio transceiver 30 (preferably via a transcoder 29) and a display 32 for displaying information received from the user interface 14 in response to a request initiated by a user engaging the actuator 26 within a minimum distance of the user interface 14. In one embodiment, the remote communication token 16 includes a timer 33 to power down the remote communication token 16 within a pre-defined time limit after the remote communication token has been engaged, thereby conserving battery power. In another embodiment, the remote communication token automatically powers down after a user disengages the actuator 26.

The controller 12 can be, for example, a laptop computer, a tablet computer, or other device that is used to program or otherwise update the user interface 14. However, the user interface 14 is more preferably updated over a local area network or the World Wide Web based on a connection with a remote administrator as discussed in more detail below. In some embodiments, a controller 12 is not needed because the remote administrator takes care of updating software, tracking audit information and storing audit records.

A specific example of how the facility status communications apparatus 10 could be used includes use for banking locations where valuable assets are stored. In the morning, workers at a banking facility location are required to take certain safety measures to ensure it is safe for employees and others to enter such facility. The facility status communications apparatus 10 can be used to improve this protocol wherein banking employees (and perhaps others) are provided a remote communication token, each with its own unique identification information. When an employee approaches the applicable facility, the employee can engage the remote communication token, thereby sending an information request to the user interface at the facility. If this employee is the first to arrive that particular morning, the response signal received at the employee's remote communication token would indicate the employee is the first to arrive through the remote communication token display (e.g., a message that says, for example, "first"). The employee would then enter the facility; perform a sweep of the facility according to a particular protocol for that particular facility and/or company to, for example, verify that the facility is safe for other personnel to enter; and then enter a confirmation code at the user interface itself. If the facility is safe to enter, the first arriving person enters a confirmation code that he or she knows will cause the user interface 14 to, upon request, thereafter (until changed) transmit response signals to remote communication tokens to indicate to other personnel that the facility is safe to enter.

Preferably, after the first employee or person to arrive at a facility receives a response signal indicating he or she is the first to arrive, a timer 34 in communication with the microprocessor 22 begins to count down. If, for example, such employee does not make it to the user interface 14 to input a confirmation code within a minimum time kept by the timer 34, an updated status is set by the user interface 14 whereby any subsequently arriving employees, upon engaging their respective remote communication token, would receive a response signal with an indication to not enter the facility. Additionally, in preferred embodiments, a notice message would be sent to one or more administrators notifying such person(s) and/or devices that the first person to enter a particular facility has failed to enter a proper confirmation code at the user interface 14 within the time limit set for the timer 34. After receiving such notice message, the administrator(s) can then take further action as necessary (e.g., update a present status condition of the facility on the user interface; call third-party personnel to investigate; call the person who failed to enter the code directly via cell phone, send an electronic e-mail message or text message to other employees). The notice message can be sent in different ways including, for example, via electronic mail, text message, a tweet via Twitter™, an automated facsimile, an automated voicemail message, an instant message, or other similar electronic communication service or platform.

Preferably, the remote communication token 16 also includes a "panic button" functionality wherein, for example, a user can hold down the actuator 26 for an extended period of time (e.g., from about three seconds to about eight seconds) which will cause a notice message to be sent from the user interface 14 to an administrator. The duration during which a user holds down the actuator can be kept by the timer(s) at the user interface 14 or, alternatively, by the timer 33 on board the remote communication token 16 in communication with the microcontroller 28. If the timer 33 on board the remote communication token 16 is used, the signal sent from the remote communication token 16 would be modified by the microcontroller 28 so that the user interface 14 interprets the incoming signal as one associated with the "panic button" feature as opposed to a standard request or confirmation signal from the remote communication token. In order for the panic button functionality to work, the applicable remote communication token must be within a minimum proximity of a user interface, wherein such minimum proximity ranges from about 50 feet to about 500 feet.

In one embodiment, the user interface 14 includes a user interface display 36 that displays a confirmation code or indicia to a user to help confirm to the user that he or she has properly entered information for a given situation. In embodiments in which the user input device 18 is in the form of a touchscreen, the interface display 36 and the user input device 18 can be one in the same apparatus. In one scenario, a user can input a discrete communication code to the user interface 14 wherein such user knows the code is to communicate that he or she is under duress, but wherein the user interface display 36 exhibits a false indicia (e.g., the term "clear" or "deactivated") so that any person placing the user under duress will not feel that his or her malevolent activities are being thwarted (e.g., via a discrete notice message). Alternatively, if the first-arriving person is not under duress but becomes aware that a notice condition exists within the facility, the user has the option to enter a code causing a notice message to be transmitted from the user interface 14 to an administrator which preferably results in the administrator resetting the present status condition of the applicable facility.

Preferably, employees also are responsible for checking out of a facility that uses a facility status communications apparatus 10. The phrase "checking out" is defined as somewhat the opposite of when employees and others arrive from outside of a facility. When checking out, an employee inputs a departure code at the user interface 14 prior to exiting the facility. Preferably, the timer 34 begins counting after a person enters a departure code. After such person is in a safe place away from the facility, he or she engages his or her remote communication token 16 which causes a signal to be transmitted to the user interface 14 to confirm that the he or she has safely left the facility, thereby stopping the timer 34. If a signal is not received by the user interface 14 from the remote communication token 16 of such departing person within a pre-defined time period being kept by the timer 34, preferably, a notice message will be transmitted to notify an administrator that the last person to exit a particular facility has not confirmed that he or she has safely left the facility premises within the predefined time period. The administrator can then take additional steps as necessary to further investigate the matter. In some embodiments, if the person checking out is the last person to exit a particular facility, he or she can enter a special last departure code into the user interface 14, thereby causing this information to be transmitted to an administrator which, in turn, will reset the present status condition of the facility. Alternatively, the facility status communications apparatus 10 can include a clock 37 that automatically resets the present status condition of a facility after normal operating business hours (e.g., at 2:00 am). In this way, regardless of whether an employee remembers to enter a last departure code at the user interface 14, the present status condition of the facility will still nonetheless be reset based on the clock 37 so that, for example, the next morning, the user interface 14 will let the first arriving person on the following day know that he or she is the first to arrive after he or she engages his or her remote communication token 16 upon arrival at the applicable facility.

Figure 4:
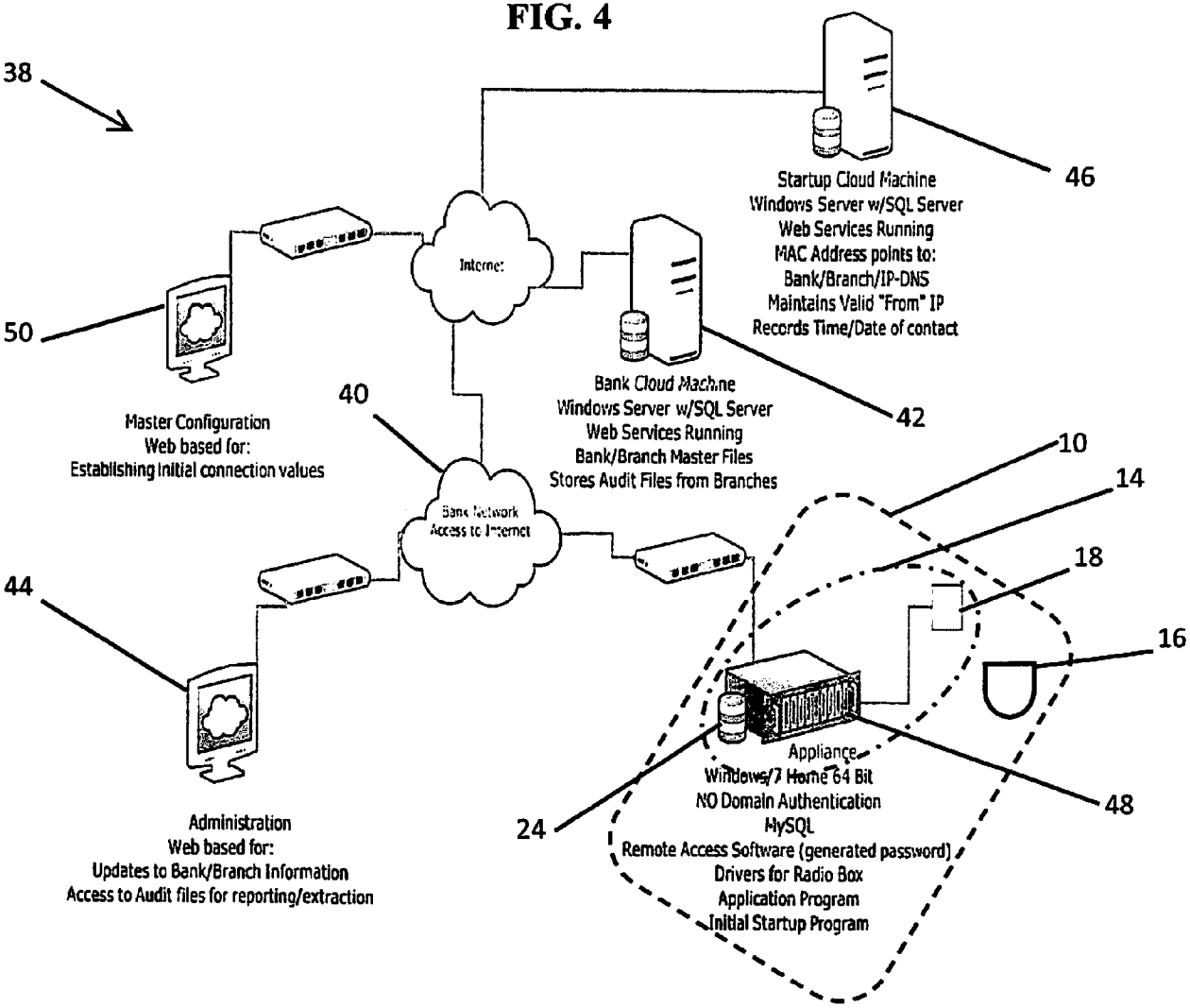
FIG. 4 shows a schematic view of a facility status communications system.

A more detailed embodiment of the facility status communications apparatus 10 is shown in FIG. 4 which more broadly shows a schematic view of a facility status communications system 38. The facility status communications system 38 includes at least one facility status communications apparatus 10 but can include many more, for example, to operate among multiple, remotely located, facilities (e.g., a plurality of banking facilities, a plurality of pharmacies, a plurality of jewelry stores). The facility status communications system 38 also preferably includes a "local" network 40 which can include, for example, a network connecting a plurality of facilities across a broad geographic area. Preferably, the local network 40 is connected to the Internet and/or is accessible on the World Wide Web. If no local network is used, the user interface(s) is/are connected to the Internet and/or accessible on the World Wide Web. The facility status communications system 38 further includes an administration control apparatus 42 such as, for example, a computer for administration for one or more facilities including, for example, a Microsoft Windows server or the like and, for example, a Structured Query Language ("SQL") server, wherein a company's or organization's master files are stored and preferably backed up including, for example, audit files sent from each applicable facility or group of facilities. The administration control apparatus 42 is preferably accessible by, for example, a first remote computer 44 (e.g., a laptop computer connected to the administration control apparatus via the local network). The administrative control apparatus 42 can generate reports for a company or companies using the applicable facility or facilities, extract audit information, and/or update information and/or software for one or more particular user interfaces at one facility location or any and all applicable facilities as a whole.

Preferably, the facility status communications system 38 also includes a master configuration apparatus 46 which manages the initial configuration and setup of a user interface 14 at a particular facility. The setup process originates centrally from the master configuration apparatus 46 and is provided to the applicable user interface(s) upon request from the user interface(s). The master configuration apparatus 46 provides ways to establish initial connection values for all related facilities—in other words, it allows for "plug and play" functionality very soon after a user interface including, for example, an appliance 48 is put in communication with the master configuration apparatus 46. Each user interface preferably periodically requests software updates from the master configuration apparatus 46 every so often (e.g., every five minutes, every hour, or every day). This "plug and play" functionality is made possible in part based on a startup database of information stored on the master configuration apparatus 46 that maintains valid "From" Internet Protocol ("IP") address information and records the time and date of initial contact from, for example, the appliance 48. The Media Access Control ("MAC") address unique to each appliance can be cross-referenced with data stored in the startup database identifying a particular company/organization, particular facility within such company/organization, and the specific IP address. After a connection has been established between the appliance 48 and the master configuration apparatus 46, management of the appliance 48 reverts to the administration control apparatus 42. The master configuration apparatus 46 is preferably accessible by, for example, a second remote computer 50 (e.g., a laptop computer connected to the master configuration apparatus via the Internet).

If any part of the facility status communications system 38 fails to operate properly based on, for example, loss of power, software failure, loss of communication, mechanical failure, or other reason(s), the user interface 14 will fail to routinely report to the administration control apparatus 42, thereby triggering a notice condition at the administration control apparatus 42.

In addition to providing information, notification, and communication to and/or between a facility or group of related facilities, the facility status communications system 38 also provides a way for a company to track the coming and going of its employees and maintain audit records based on when employees check in and out of a work location. This cache of information is stored remotely from the facilities (i.e., for example, at the administration control apparatus 42) and can be organized into reports available to companies using the hardware and software associated with the facility status communications system 38.

In another embodiment, instead of using a remote communication token 16, users of a facility status communications apparatus and/or system can download an app for use on such user's cellular telephone wherein each download has a unique and secure identification associated with it. Preferably, only persons with a proper password and/or other authentication are even able to access the app and download it. Alternatively, the application is easily downloaded but can only be run on devices on which, for example, a proper authentication code has been entered. Once downloaded, the application allows a user's cellular telephone to communicate via an encrypted wireless link with a particular user interface 14 (e.g., sending and receiving signals through an encrypted WiFi™ network), thereby obviating the need for a separate remote communication token.

Figure 5:
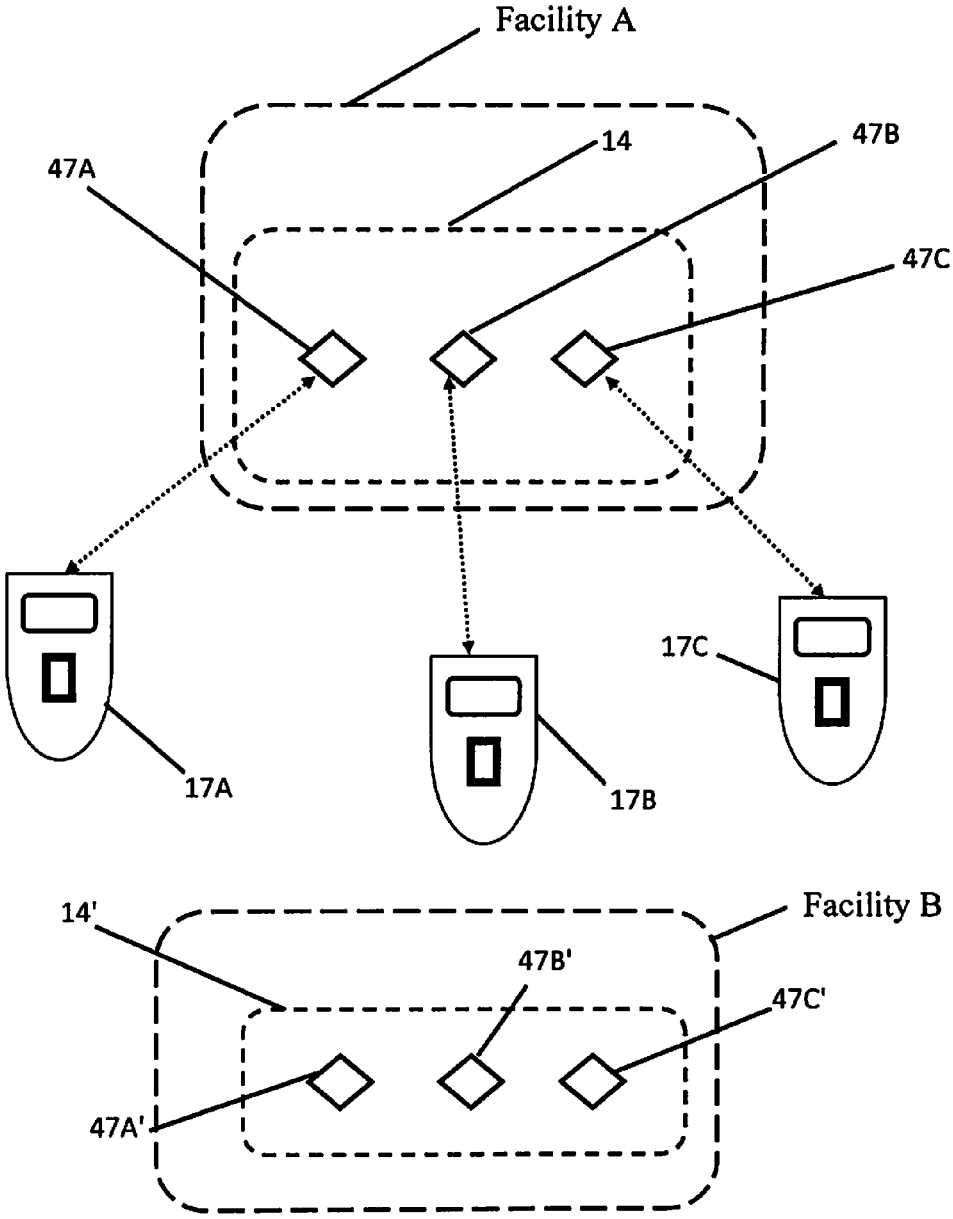
FIG. 5 shows a plurality of remote communication tokens paired with a plurality of timers associated with a facility status communications system.

In one embodiment of the facility status communications system 38, certain remote communication tokens 17 are individually tied to specific timers 47 at the user interface 14 or the administration control apparatus 42 wherein a first timer 47A is uniquely programmed for a task schedule associated with a person using a first remote communication token 17A, a second timer 47B is uniquely programmed for a task schedule associated with a person using a second remote communication token 17B, and a third timer 47C is uniquely programmed for a task schedule associated with a person using a third remote communication token 17C as shown in FIG. 5. The example shown in FIG. 5 is one in which the timers 47 are located at the user interface 14, wherein virtually identical or similarly functioning timers 47A', 47B', and 47C' are located at a related facility having its own user interface 14'. When the timers 47 are maintained at the administration control apparatus 42, there is no need to duplicate timers at various facility locations. Using either embodiment, for example, a person using the first remote communication token 17A might be a courier that has a schedule on which he or she is expected to deliver or pick up packages at specific locations in a specific order at specific times. The courier using the first remote communication token 17A can be tracked and his or her progress checked based on the times when he checks in to each applicable facility location using his or her first remote communication token 17A. A second person using the second remote communication token 17B might be on a completely different schedule and might not be a courier. Because each of the remote communication tokens 17 are tied to different timers 47, these three persons can each be tracked separately, wherein each of them develops a separate and unique audit record during a business day. If, for example, the courier fails to engage the first remote communication token 17A within a specified time period proximate a specified facility having a user interface for communicating with the first remote communication token, that particular user interface can then send a notice message to an administrator, thereby providing virtually immediate status information on the progress of persons traveling among facilities using the facility status communications system 38.

Figure 6:
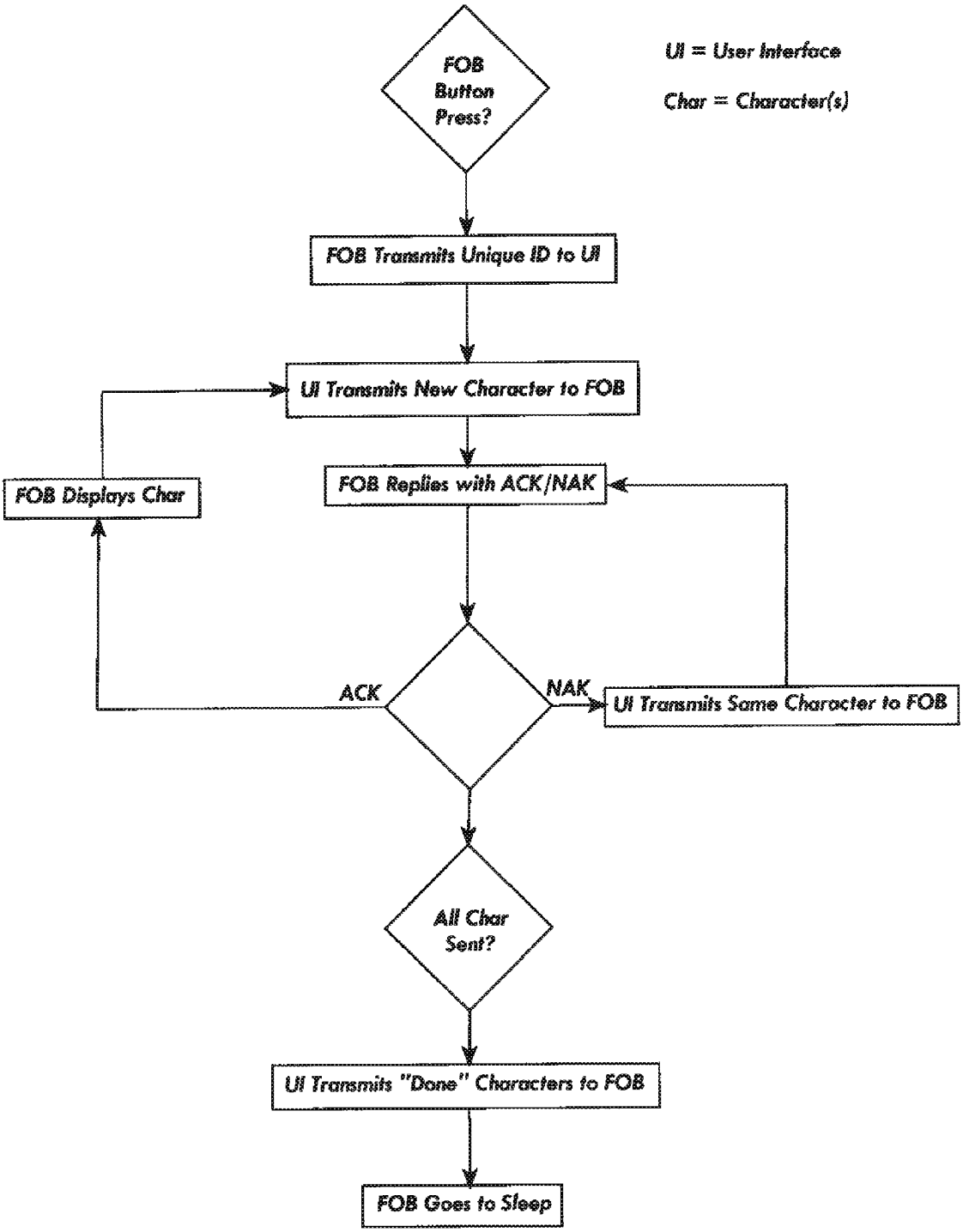
FIG. 6 shows a schematic flowchart of an example of a method of providing up-to-the-minute status information for a particular facility.

In addition to the facility status communications apparatus 10 and facility status communications system 38 described above, various related methods are also contemplated in this disclosure including those described below and, for example, as shown in FIG. 6. In a first embodiment, a method of confirming the status of a facility includes the steps of (a) storing a present status condition value of the facility; (b) transmitting a first request signal from a remote communication token within a minimum range of a user interface located in or proximate a facility; (c) receiving the first request signal at the user interface; (d) transmitting a first reply signal from the user interface in response to the first request signal, wherein the transmitted first reply signal is based on the present status condition of the facility; (e) receiving the first reply signal at the remote communication token; and (f) displaying a message on the remote communication token indicating the present status condition of the facility.

Step (c) can further include the sub-step of assigning a type of signal to send to the remote communication token based on a present status condition assigned to the facility, such present status condition preferably being held at the user interface and/or the administration control apparatus 42). The present status condition of the facility can set by the user interface and/or an administration control apparatus based on factors such as whether an authorized person has already entered the facility within a defined timeframe (e.g., a calendar day); whether an authorized person already located inside the facility has entered a confirmation code; whether a proper access code was entered by an authorized person within a predefined time limit after the authorized person transmitted the first request signal; and, if a present authorized person has entered a code, which code the authorized person entered (e.g., a code indicating a notice condition or a code indicating a nominal condition). Examples of status conditions can include, for example, a nominal entrance condition (confirmation after a person has entered a facility and "swept" the facility, thereby causing a "safe to enter" signal to be sent to any subsequently arriving persons that transmit a request signal), a nominal closed condition (confirmation after a last person has safely exited the facility, thereby causing the user interface to let any subsequently arriving person know that he or she is the first to arrive), and a notice condition (causing subsequently arriving persons that transmit a request signal to the user interface to be told to, for example, stay out of the facility). Although specific examples of present status conditions are given herein, this list is not meant to be limiting and many other scenarios of defined present status conditions are contemplated herein.

Step (e) can further include the sub-step of confirming the first reply signal was received by the remote communication token.

Step (f) can further include displaying a message on the remote communication token based on data transmitted within the first reply signal wherein the displayed message communicates that the user is the first person to transmit a request signal during that particular defined timeframe, thereby prompting the user to approach the facility to enter a confirmation code at the user interface.

An additional step can include (g) transmitting a notice message to an administrator if the confirmation code entered is associated with a notice condition (e.g., if the user becomes aware of a threat and enters a confirmation code that relays such information to an administrator). The administrator can then optionally initiate a step of (h) contacting a third party to respond to the situation indicated by the notice message (e.g., contact police, fire department, ambulatory service, or other professional service that might be needed).

In a related embodiment, the method includes the steps of (g)' inputting a confirmation code at the user interface within a pre-set time limit after the first reply signal was sent and (h)' updating a present status condition of the facility.

Alternatively, the method includes the step of (g)" saving identification information associated with the remote communication token and (h)'" saving the time at which the remote communication token transmitted the first request signal.

For situations in which the user interface and/or other associated hardware loses power, is relegated to back-up battery power, and/or experiences a mechanical or software malfunction, a notice condition exists and is interpreted as such when and if the user interface 14 fails to check in with the administration control apparatus 42 when the user interface 14 is regularly scheduled to do so.

The previously described versions of the present disclosure have many advantages, including unambiguous and rapid transfer of facility status information to persons planning to enter a facility. In embodiments in which a system is connected to the Internet or even a local area network, information regarding the status of a facility almost instantly can be made available to an entire network of employees, other facilities, service personnel, and public service officials. Facility status data and even specific employee data can be stored for analysis and, in certain embodiments, such data can be stored off-site, for example, on a remote memory storage device to later provide analytics to companies about the comings and goings of personnel at their facilities. Versions of the disclosure provide for discrete notice condition features that would inform authorized personnel outside of a facility not to enter such facility while, at the same time, not alerting unauthorized persons inside the facility that a notice message has been sent. For example, the word "clear" might appear on the remote communication tokens of employees wherein such term seems inconspicuous to an unauthorized person inside the applicable facility that may be placing authorized personnel inside the facility under duress, but authorized personnel outside the facility know to interpret that particular term to mean that an authorized person is currently under duress and that no one should approach the facility.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An apparatus for notifying personnel associated with a facility of the status of such facility including whether a notice condition presently exists at such facility, the apparatus comprising: a primary power source, a user interface located in or adjacent a facility, the user interface including a microprocessor, a user input device in communication with the microprocessor, and a first transceiver in communication with the microprocessor; and a plurality of remote communication tokens, each token including a remote power source, an actuator, a microcontroller in communication with the actuator, a second transceiver in communication with the microcontroller wherein each of the second transceivers are configured for sending signals to and receiving signals from the first transceiver, and a display in each of the remote communications tokens for displaying information based on signals received from the first transceiver, wherein human interaction is required from a first person to input a confirmation code to the user interface indicating whether the facility is safe to enter for subsequent arriving persons or whether a notice condition exists at such facility, wherein, if the notice condition exists and the confirmation code has been entered indicating such notice condition, a subsequently arriving person using a particular communication token, upon properly engaging the actuator of such particular communication token, will receive a warning message on the subsequently arriving person's particular communication token display while the subsequently arriving person is still safely outside the facility, such warning message indicating the subsequently arriving person should remain outside of the facility.

2. The apparatus of claim 1 further comprising a timer in communication with the microprocessor, the timer configured to keep track of one or more time periods after a signal is received by the first transceiver from the second transceiver wherein such signal was initiated by a first person to arrive at the facility on a particular day.

3. The apparatus of claim 1 further comprising a controller configured to directly communicate with the user interface and update information stored in the user interface.

4. The apparatus of claim 1 further comprising a first transcoder in communication with the first transceiver and the microprocessor; and a second transcoder in communication with the second transceiver and the microcontroller.

5. A method of confirming the status of a facility including whether a notice condition presently exists at such facility, the method comprising the steps of (a)(1) conducting a manual security sweep of a facility; (a)(2) inputting a confirmation code manually at a user interface based on a result of the manual security sweep; (a)(3) updating a present status condition of the facility automatically using the user interface in response to the manually input first confirmation code; (b) transmitting a first request signal from a remote communication token within a minimum range of the user interface located in or proximate the facility; (c) receiving the first request signal at the user interface; (d) transmitting a first reply signal from the user interface in response to the first request signal, wherein the transmitted first reply signal is based on the present status condition of the facility; (e) receiving the first reply signal at the remote communication token; and (f) displaying a message on the remote communication token indicating the present status condition of the facility, wherein human interaction is required from a first person to input the confirmation code to the user interface indicating whether the facility is safe to enter for subsequent arriving persons or whether a notice condition exists at such facility, wherein, if the notice condition exists and the confirmation code has been entered indicating such notice condition, a subsequently arriving person using a particular communication token, upon properly engaging an actuator of such particular communication token, will receive a warning message on a communication token display on the subsequently arriving person's particular communication token while the subsequently arriving person is still safely outside the facility, such warning message indicating the subsequently arriving person should remain outside of the facility.

6. The method of claim 5 wherein step (c) further comprises the substep of verifying an identity of the remote communication token that transmitted the first request signal to determine whether the first request signal originated from an authorized remote communication token.

7. The method of claim 6 further comprising the step of (g)' inputting the confirmation code at the user interface within a pre-set time limit after the first reply signal was sent.

8. The method of claim 7 further comprising the step of (h)' updating a present status condition of the facility.

9. The method of claim 8 wherein step (h)' further comprises the substep of authenticating the confirmation code entered at the user interface prior to updating the present status condition of the facility.

10. The method of claim 7 wherein the confirmation code entered at the user interface is associated with a notice condition, the method further comprising the steps of (h)" sending the notice message to an administrator based on the type of notice condition indicated by the confirmation code entered at the user interface; and (j) updating the present status condition of the facility.

11. A notification system for notifying personnel associated with one or more facilities of the status of at least one of the one or more facilities including whether a notice condition presently exists at one or more of the facilities, the notification system comprising: a user interface located in or adjacent each facility, each user interface including a microprocessor, a user input device in communication with the microprocessor, and a primary transceiver in communication with the microprocessor; and a plurality of remote communication tokens, each remote communication token including an actuator, a microcontroller in communication with the actuator, a secondary transceiver in communication with the microcontroller wherein each of the secondary transceivers are configured for sending signals to and receiving signals from a primary transceiver of the one or more user interfaces, and a display in each of the remote communications tokens for displaying information based on signals received from a primary transceiver of the one or more user interfaces, wherein human interaction is required from a first person to input a confirmation code to at least one of the user interfaces indicating whether the facility associated with the at least one of the user interfaces is safe to enter for subsequent arriving persons or whether a notice condition exists at the facility associated with the at least one of the user interfaces, wherein, if the notice condition exists and the confirmation code has been entered indicating such notice condition at the facility associated with the at least one of the user interfaces, a subsequently arriving person using a particular communication token, upon properly engaging the actuator associated with the particular communication token, will receive a warning message on the subsequently arriving person's particular communication token display while the subsequently arriving person is still safely outside the facility associated with the at least one of the user interfaces, such warning message indicating the subsequently arriving person should remain outside of the facility associated with the at least one of the user interfaces.

12. The notification system of claim 11 further comprising an administration control apparatus remotely located relative to the one or more facilities wherein the administration control apparatus is in communication with the respective user interfaces at each of the one or more facilities via a local area network, the Internet, or a combination thereof, and wherein the administration control apparatus is configured to receive notice messages from the respective user interface at each of the one or more facilities, and assign present status conditions for the one or more facilities based at least in part on the receipt of such notice messages.

13. The notification system of claim 12 comprising the administration control apparatus wherein the administration control apparatus is configured to receive audit information from each user interface on a time interval of at least less than every twenty-four hours.

14. The notification system of claim 12 comprising the administration control apparatus wherein the administration control apparatus is further configured to store information including audit information.

15. The notification system of claim 12 further comprising a master configuration apparatus remotely located relative to the one or more facilities wherein the master configuration apparatus is in communication with each respective user interface via a local network, the Internet, or a combination thereof, and wherein the master configuration apparatus is configured to manage the initial configuration and setup of each respective user interface at the one or more facilities.

16. The notification system of claim 15 comprising the master configuration apparatus wherein the user interfaces are identifiable based on unique Media Access Control addresses associated with respective user interfaces, such Media Access Control addresses being stored in the master configuration apparatus; and wherein the master configuration apparatus is configured for at least storing valid Internet Protocol address information of Internet Protocol addresses directly associated with new hardware that forms at least part of each respective user interface, such storage of valid Internet Protocol address information providing cross-referencing capability for the master configuration apparatus to identify specific customer identities based on the Internet Protocol addresses and Media Access Control addresses from which each customer's new hardware sends out an initial signal to the master configuration apparatus.

17. The method of claim 5 further comprising the step of (g)" saving identification information associated with the remote communication token and (h)''' saving the time at which the remote communication token transmitted the first request signal.

18. The method of claim 17 further comprising the steps of (i)' initiating a timer to count down the time between the saved time at which the remote communication token transmitted the first request signal and a future time window during which a subsequent request signal is expected to be transmitted from the remote communication token and received at a second user interface located at a facility remote from the facility at which the first user interface is located; and, in the event a subsequent request signal is not received at the second user interface from the remote communication token within the future time window, (j) sending a notice message from the second user interface to an administrator.

* * * * *